United States Patent [19]

Pollak

[11] 4,339,087

[45] Jul. 13, 1982

[54] CRUSHER HEAD SUPPORTING UNIT FOR A GYRATORY CRUSHER

[75] Inventor: Robert J. Pollak, Appleton, Wis.

[73] Assignee: Allis-Chalmers Corporation, Milwaukee, Wis.

[21] Appl. No.: 184,633

[22] Filed: Sep. 8, 1980

[51] Int. Cl.[3] ..... B02C 2/04

[52] U.S. Cl. ..... 241/211; 241/207

[58] Field of Search ..... 241/207, 211, 213–215, 241/290

[56] References Cited

U.S. PATENT DOCUMENTS

| | | | |
|---|---|---|---|
| 3,481,548 | 12/1969 | Beisner et al. | 241/215 |
| 3,801,026 | 4/1974 | Decker et al. | 241/211 X |
| 4,060,205 | 11/1977 | Pollak | 241/290 X |
| 4,206,881 | 6/1980 | Werginz | 241/207 |

*Primary Examiner*—Eugene F. Desmond
*Attorney, Agent, or Firm*—Thomas G. Anderson

[57] ABSTRACT

A piston and cylinder unit for a gyratory crusher including a cylinder having an upper piston carrying the crusher head and a lower piston dividing the interior of the cylinder into a hydraulic chamber and a gas chamber. The hydraulic chamber is selectively chargeable with hydraulic fluid to adjust the crushing gap between the crusher head and the bowl of the crusher, and the gas chamber is connected in communication with a pressure relief chamber within the lower piston to provide an accummulator within the unit accommodating the momentary displacement of the crusher head by noncrushable materials moving through the crushing gap during crushing operations.

10 Claims, 6 Drawing Figures

CRUSHER HEAD SUPPORTING UNIT FOR A GYRATORY CRUSHER

BACKGROUND OF THE INVENTION

1. Field of the Invention

The present invention relates to gyratory crushers and in particular to a piston and cylinder arrangement supporting the crusher head accommodating momentary displacement of the head to allow noncrushable materials to pass through the crusher.

2. Description of the Prior Art

The prior art includes a variety of gyratory crushers wherein the crusher head is supported by a hydraulic system which includes means for lowering the crusher head to allow tramp iron or other noncrushable materials to pass through the crusher.

Typically, as shown in U.S. Pat. No. 4,060,205, the main shaft of the crusher head is supported by a hydraulic piston and cylinder unit which is supplied with hydraulic fluid by a pump and accumulator which can be actuated to maintain the desired crushing gap between the crusher head and the bowl of the crusher. This type of arrangement has generally been necessary in order to compensate for wear in the surface of the crusher head during use. In the event a piece of tramp iron is fed into the crusher, the crusher head is driven down by the tramp iron which tends to jam in the crushing gap until the gap is sufficiently enlarged to allow this material to pass through the crusher. This downward movement of the crusher head effectively forces the hydraulic fluid in the unit through a conduit into the accumulator until the tramp iron passes through the gap. Thereafter, once the tramp iron has passed through the gap, the accumulator forces the fluid back through the conduit and into the unit which returns the crusher head to its normal operating position.

While tramp iron relief arrangements such as the foregoing have been for the most part satisfactory, the frictional losses inherent in any system requiring the movement of hydraulic fluids through a series of conduits necessarily retards or reduces the response time of the system. This response time, or the time required to lower the crusher head sufficiently to allow a piece of tramp iron to pass through the crushing gap, is particularly important since the longer a piece of tramp iron remains jammed in the crushing gap, the greater the likelihood of damage to the crusher head and its driving mechanism.

SUMMARY OF THE INVENTION

The present invention relates to a supporting unit adapted to support the crusher head of a gyratory crusher in selectively spaced relation to the crusher bowl while accommodating momentary displacement of the crusher head to allow noncrushable materials to pass through the crusher.

The supporting unit includes a cylinder mounted on the frame of the crusher beneath the head shaft carrying the crusher head, and a pair of pistons reciprocably mounted within the cylinder. The uppermost of the pistons is adapted to support the head shaft, and the other piston is mounted between the upper piston and closed lower end of the cylinder to divide the interior of the cylinder into a gas chamber and a hydraulic chamber. The gas chamber is precharged with pressurized gases to form a fluid cushion within the chamber and the hydraulic chamber is selectively charged with hydraulic fluid to adjust the crushing gap between crusher head carried by the upper piston and the crusher bowl mounted on the frame of the crusher.

When a piece of tramp iron or other noncrushable material is fed into the crusher, the crusher head is forced down by the tramp iron until the gap is sufficiently enlarged to allow the material to pass through the crusher. As a result, both of the pistons are driven down in the cylinder to compress the gases in the gas chamber. As the gases are compressed, they flow into a pressure relief chamber in the lower piston through a one-way check valve in the piston between the gas and relief chambers. Thereafter, once the material has passed through the crushing gap, the gases flow back into the gas chamber from the relief chamber through a return port which throttles the flow to stabilize the system as the pistons and crusher head are returned to their normal operating position by the compressed gases.

From the foregoing, it can be seen that the invention contemplates a tramp iron relief arrangement which substantially enhances the response time of the system which is also easy to adjust and maintain in the field. It is to be understood that various changes can be made in the arrangement, form and construction of the apparatus disclosed herein without departing from the spirit and scope of the invention.

DESCRIPTION OF THE PREFERRED EMBODIMENT

Figures 1, 3, 4:
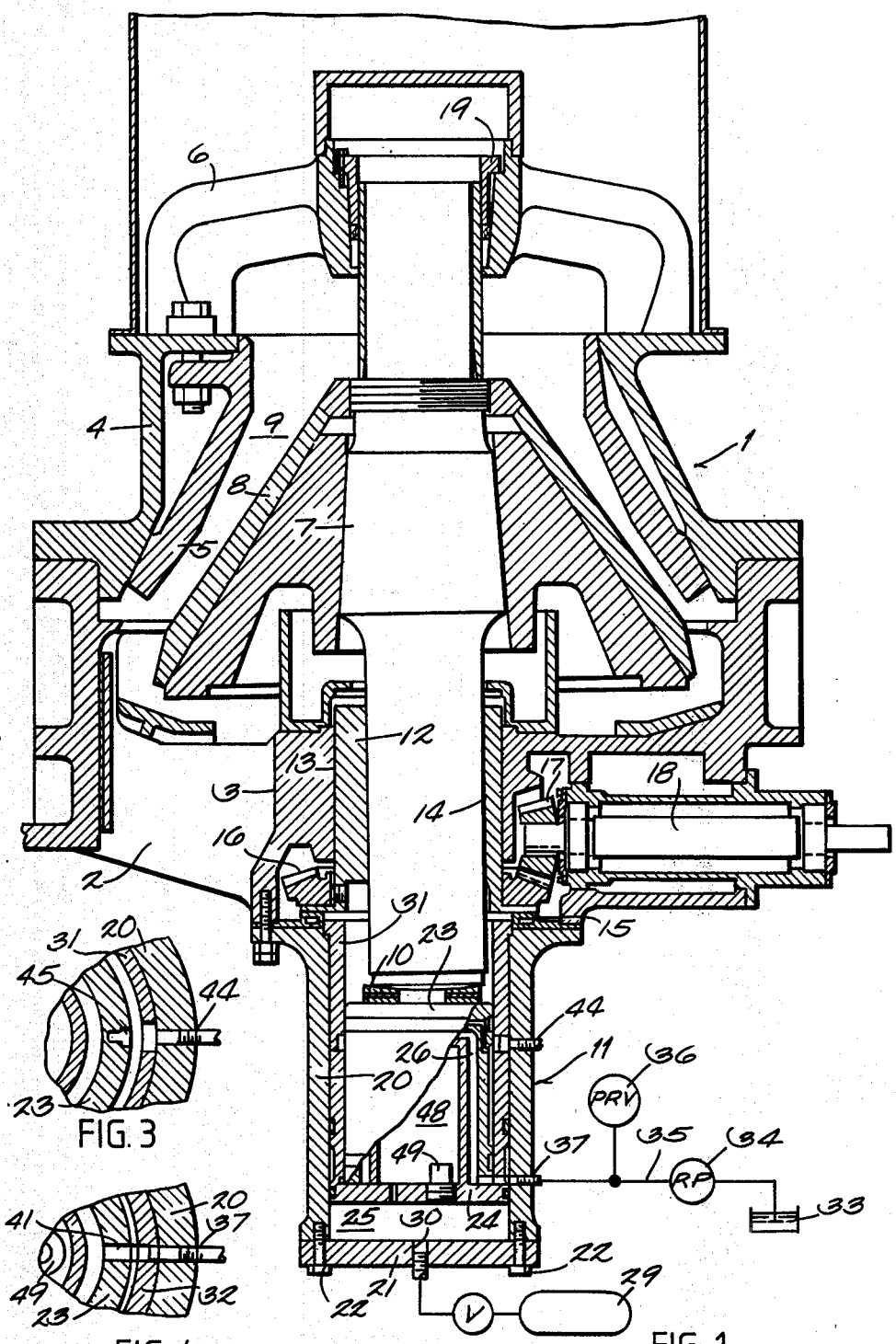
FIG. 1 is an elevational view, partially in section, of a gyratory crusher including the piston and cylinder unit embodying the invention.
FIG. 3 is a cross-sectional view taken substantially along line III—III in FIG. 2.
FIG. 4 is a cross-sectional view taken substantially along line IV—IV in FIG. 2.

Referring to FIG. 1, the gyratory crusher 1 embodying the invention includes a lower frame 2 provided with a vertical hub 3, an upper frame 4 supporting a crusher bowl or liner 5, a spider-like frame 6 mounted on the upper frame 4, and a centrally located gyratable head shaft 7 carrying a crusher head or cone 8 in spaced relation to the interior of the bowl to provide an annular crushing zone or gap 9 between the bowl and the crusher cone. The head shaft 7, which is carried on an axial thrust bearing 10 supported by a piston and cylinder unit 11 mounted on the lower frame 2 beneath the shaft, is rotatably journaled within an eccentric sleeve bearing carried within the vertical hub 3 to direct the gyratory movement of the shaft. As shown in FIG. 1, the sleeve bearing includes an eccentric sleeve 12 having an outer cylindrical surface 13 journaled within the hub 3 and an eccentrically disposed internal bore 14 which receives the shaft 7 along an axis inclined to the external surface of the sleeve. The eccentric sleeve is carried by a supporting bearing 15 on the lower frame 2 and includes a ring gear 16 secured about its periphery which is driven by a driving pinion 17 mounted on a horizontally extending drive shaft 18 journaled within the lower frame 2. The drive shaft 18 is connected with a suitable rotary drive (not shown) which in turn rotates the sleeve 12 through the ring gear 16 and pinion 17 to effect gyratory movement of the head shaft about the bushing 19 mounted in the spider-like frame 6 as is well known in the art.

The piston and cylinder unit 11 includes an outer cylindrical casing 20 having an open upper end and a closed lower end which is enclosed by a removable cover plate 21 secured to the casing by bolts 22 or the like. As shown in the drawings, a pair of cylindrical pistons 23 and 24 are reciprocably mounted within the cylindrical casing 20 to form a gas chamber 25 and a hydraulic chamber 26, it being noted that piston rings or seals 27 and 28 are secured in associated annular grooves about the respective peripheries of the pistons to seal each of the chambers 25 and 26 within the casing. The gas chamber 25 is connected with a conventional gas storage cylinder 29 through a valved inlet 30 in the cover plate 21 secured to the lower end of the casing. This arrangement accommodates precharging of the gas chamber 25 with air, or preferably nitrogen, to form a fluid cushion urging the lower piston 24 against a fixed cylindrical bushing 31 secured in the casing above the piston 24. The upper piston 23, which is sized to reciprocate within the bushing 31 and the outer cylindrical wall 32 of the lower piston 24, cooperates with the lower piston 24 to contain the hydraulic chamber 26. Hydraulic fluid is supplied to the hydraulic chamber 26 from a hydraulic reservoir 33 by a reversible pump 34 connected via conduit 35 having a pressure relief valve 36 to a port 37 in the wall of the casing. The port 37 opens into an external annular groove 38 about the circumference of the outer cylindrical wall 32 which in turn opens into an internal annular groove 39 about the inner face of the wall 32 through a plurality of ports 40 spaced about the circumference of the wall, and the internal groove 39 communicates with the hydraulic chamber 26 through a series of ports 41 spaced about the circumference of the cylindrical wall 42 of the upper piston 23. Thus, by using the reversible pump 34 to vary the quantity of hydraulic fluid in the hydraulic chamber 26, an operator can adjust the axial spacing between the upper piston 23 carrying the head shaft 7 and the normally stationary lower piston 24 to maintain the desired crushing gap between the crusher head and the crusher bowl, and, in the event a particularly large piece of tramp iron becomes jammed in the crushing gap causing the lower piston 24 to bottom-out in the cylinder, the pressure relief valve 36 accommodates evacuation of hydraulic fluid from the hydraulic chamber 26 to allow the upper piston and thus the crusher head to drop to prevent damage to the crusher head and driving mechanism. Additionally, it should be noted that the upper piston 23 includes a duct 43 for directing lubricant to the thrust bearing 10 from a lubricant port 44 including an interiorly opening annular groove in the wall of the bushing 31 through an exterior groove 45 in the periphery of the upper piston.

Figure 2:
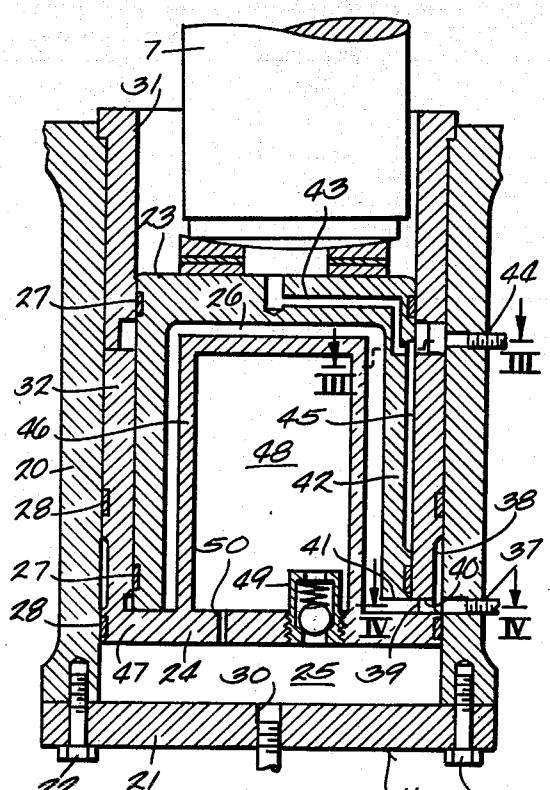
FIG. 2 is an enlarged cross-sectional view of the piston and cylinder unit shown in FIG. 1.

The lower piston 24 includes a closed housing 46 affixed to the piston head 47 which provides a pressure relief chamber 48 contained within the lower piston. The pressure relief chamber 48 communicates with the gas chamber 25 through the piston head 47 by means of a check valve 49 which accommodates one-way flow of gases from the gas chamber 25 into the pressure relief chamber 48, and through an open gas return port 50 which is sized to throttle or attenuate a return flow of gases into the gas chamber 25 to prevent the development of "water hammers" within the system as will be described. As shown in FIG. 2, the check valve 49 is preferably of a conventional ball and spring design which is adapted to open only when the pressure in the gas chamber 25 exceeds the pressure in the pressure relief chamber 48.

DESCRIPTION OF OPERATION

Figure 5:
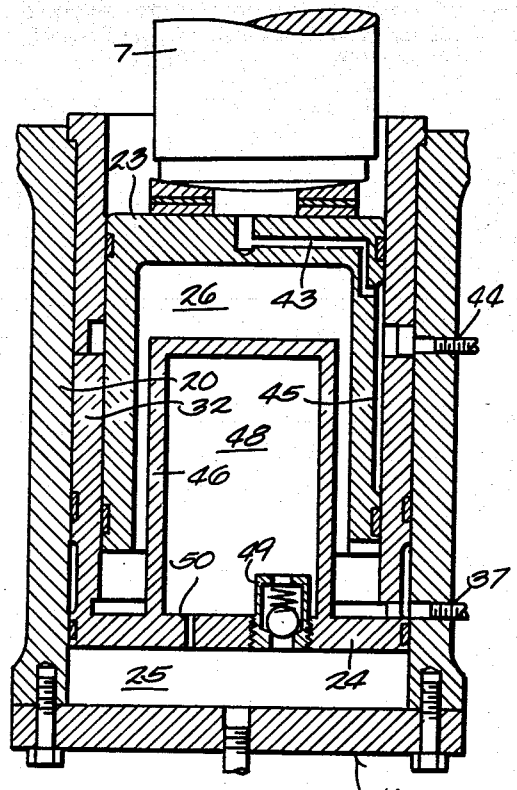
FIG. 5 is a view similar to FIG. 2 showing the crushing gap adjustment feature of the unit.

Referring to FIGS. 1 and 2, during normal crushing operations, the upper and lower pistons 23 and 24 are supported in the positions shown by the precharged gases in the gas chamber 25 and the hydraulic fluid in the hydraulic chamber 26. As can be seen from the drawing, the upper piston 23 is shown in its lowermost position relative to the lower piston 24. This position generally corresponds to the position of the upper piston after a new, unworn mantel has been installed on the crusher head. Since the rock passing through the crusher wears down the mantel after extended use, without some means of adjusting the position of the crusher head relative to the crusher bowl, the crushing gap will continue to grow until it is necessary to replace the mantel in order to continue crushing operations. As shown in FIG. 5, the present arrangement deals with this problem by providing a system wherein hydraulic fluid can be periodically pumped into the hydraulic chamber 26 to lift the upper piston 23 relative to the normally stationary lower piston 24 until the desired spacing between the crusher head and the bowl is obtained. Conversely, if it is desired to enlarge the crushing gap to produce a larger aggregate size, this process is reversed.

Figure 6:
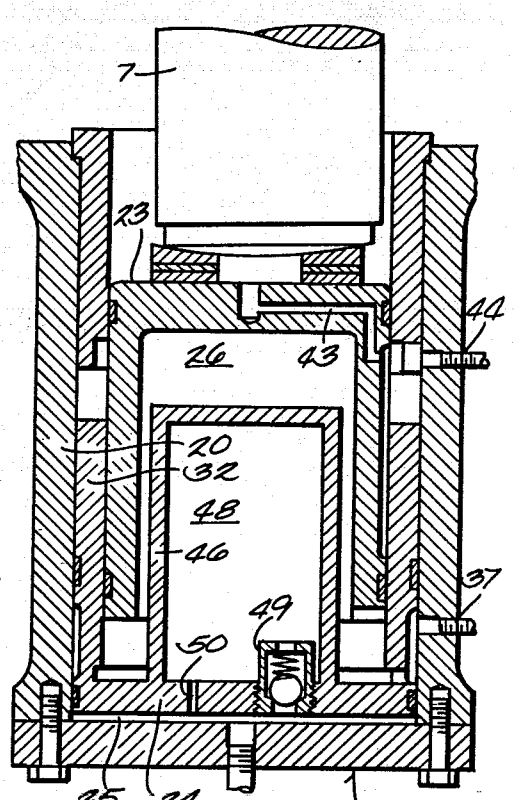
FIG. 6 is a view similar to FIG. 5 showing the general position of the pistons while tramp iron is moving through the crushing gap.

When a piece of tramp iron jams in the crushing gap, the crusher head is forced down by the jammed tramp iron. This forces upper piston 23 carrying the head shaft 7 downwardly in the casing 20 as generally shown in FIG. 6 until the tramp iron has passed through the crushing gap. Since the hydraulic fluid in the hydraulic chamber 26 maintains a relatively constant spacing between the upper and lower pistons, both pistons are driven downward in concert. Thus, as the lower piston moves down in the casing to compress the precharged gas in the gas and pressure relief chambers 25 and 48, these chambers function as an accumulator within the casing which essentially minimizes the time required to lower the crusher cone enough to allow the tramp iron to pass through the crushing gap as well as the time necessary to lift the cone back into its normal operating position. Typically, as the lower piston 24 is driven down in the casing 20, the gas pressure in both the gas and pressure relief chambers 25 and 48 increases to about 900–1000 psi from a normal operating pressure of 400–500 psi. Since the one-way check valve 49 provides negligible resistance to the gases as they flow into the pressure relief chamber to equalize the pressures in those chambers, the present arrangement has essentially eliminated any increase in the system's response time due to frictional losses such as those encountered in the hydraulic pressure relief systems discussed above in regard to the prior art.

After the tramp iron has passed through the crushing gap, the compressed gases in the gas chamber 25 act on the lower piston 24 to begin moving the pistons upwardly within the chamber and to return the crusher head to its normal operating position. The resulting pressure drop in the gas chamber 25 induces a return flow of gases from the pressure relief chamber 48 into the gas chamber 25 through the return port 50 until the crusher head has returned to its normal operating position. In that position the pressures in the gas and relief chambers are substantially the same. It should be particularly noted that the throttling or flow attenuating feature of the return port 50 enhances the stability of the system both during the compression or tramp iron relief stroke as well as during the return stroke. Specifically, when the gyrating crusher head encounters a piece of tramp iron in the crusher bowl, it tends to create pulsing pressure surges or "water hammers" within the gas chamber 25. This phenomenum is described in detail in the assignee's U.S. Pat. No. 4,060,205 which is discussed above in regard to the prior art. In the present arrangement, this problem is effectively eliminated by throttling the backflow of gases through the return port 50 during the relief or compression stroke, and by attenuating the gas flow through the return port as the crusher head returns to its normal operating position.

The embodiments of the invention in which an exclusive property or privilege is claimed are defined as follows:

1. A supporting unit for a gyratory crusher including a crusher bowl and a gyratable crusher head supported by the unit in normally selectively spaced realtion to the bowl which accommodates momentary displacement of the crusher head by noncrushable materials moving through the crusher between the head and the bowl during crushing operations, comprising:

a piston cylinder closed on one end;

first piston means for carrying the crusher head mounted within the cylinder;

second piston means mounted within the cylinder between said first piston means and the closed end of the cylinder to divide the interior of the cylinder into two chambers, one of said chambers being prechargeable with pressurized fluids to form a first fluid cushion within said chamber, and the other of said chambers being selectively chargeable with pressurized fluids to form a second fluid cushion operatively associated with said first fluid cushion for positioning said first piston means carrying the crusher head within the cylinder;

said second piston means enclosing a pressure relief chamber and having valve means providing fluid communication between said one chamber and the pressure relief chamber; and said valve means accommodating one-way flow of fluids from said one chamber into the pressure relief chamber attendant to displacement of the crusher head by noncrushable materials and attenuated flow of fluids from the pressure relief chamber into said one chamber during movement of the crusher head back to its normal operating position.

2. The supporting unit according to claim 1, and said one of the chambers being disposed between said second piston means and the closed end of the chamber; and said other of the chambers being disposed between said first and second piston means.

3. The supporting unit according to claim 1, and the fluid in said one of the chambers and said pressure relief chamber being a compressible gas; and the fluid in said other of the chambers being hydraulic fluid.

4. The supporting unit according to claim 1, and relief valve means connected in fluid communication with said other of the chambers accommodating evacuation of fluids from said chamber upon predetermined pressurization of the fluids within said chamber attendant to displacement of the crusher head by noncrushable materials.

5. The supporting unit according to claim 1, and stop means secured within the cylinder above said second piston means to limit movement of said second piston means.

6. The supporting unit according to claim 5, and said stop means comprising a cylindrical bushing having an interior diameter sized to receive said first piston means in concentric sliding relation.

7. The supporting unit according to claim 1, and said first piston means being of a generally cup-shaped configuration including a first piston head and a first cylindrical wall portion; and said second piston means including a second piston head and a second outer cylindrical wall portion concentrically receiving said first wall portion in sliding telescoping relation.

8. The supporting unit according to claim 7, and said first piston means being adapted to support bearing means carrying the crusher head;

a lubricant port in the cylinder opening into the interior of the cylinder;

a groove in said first outer cylindrical wall portion aligned in registry with said lubricant port during normal crushing operations; and a lubricant duct within said first piston head providing fluid communication between said groove and the bearing means.

9. The supporting unit according to claim 7, and said cylinder having a fluid port opening into the interior of the cylinder; and said second cylindrical wall portion have an exteriorly opening annular slot about its periphery aligned in registry with said fluid port in fluid communication with said other of the chambers.

10. The supporting unit according to claim 7, and said second piston means including a housing containing said presure relief chamber concentrically aligned within said first and second cylindrical outer wall portions.

* * * * *